US007115023B1

(12) United States Patent
Owczarz

(10) Patent No.: US 7,115,023 B1
(45) Date of Patent: Oct. 3, 2006

(54) PROCESS TAPE FOR CLEANING OR PROCESSING THE EDGE OF A SEMICONDUCTOR WAFER

(75) Inventor: Aleksander Owczarz, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 11/172,270

(22) Filed: Jun. 29, 2005

(51) Int. Cl.
*B24B 1/00* (2006.01)

(52) U.S. Cl. ..... 451/44; 451/303; 451/307; 451/5

(58) Field of Classification Search ..... 451/44, 451/59, 168, 173, 303, 307, 388, 5, 6
See application file for complete search history.

(56) References Cited

U.S. PATENT DOCUMENTS 1,843,301 A * 2/1932 Player et al. ..... 451/62
4,145,846 A * 3/1979 Howland et al. ..... 451/5
4,175,358 A * 11/1979 Bischeri ..... 451/311
4,669,224 A * 6/1987 Armstrong et al. ..... 451/296
4,671,018 A * 6/1987 Ekhoff ..... 451/308
5,099,615 A * 3/1992 Ruble et al. ..... 451/5
5,367,866 A * 11/1994 Phillips ..... 451/307
5,399,125 A * 3/1995 Dozier ..... 474/117
5,476,413 A * 12/1995 Hasegawa et al. ..... 451/168
5,485,644 A * 1/1996 Shinbara et al. ..... 15/21.1
5,490,808 A * 2/1996 Jantschek et al. ..... 451/59
5,861,066 A * 1/1999 Moinpour et al. ..... 134/6
6,059,889 A * 5/2000 Jensen et al. ..... 134/6
6,334,229 B1 1/2002 Moinpour et al. ..... 15/77
6,361,417 B1 * 3/2002 Walker et al. ..... 451/168
6,425,158 B1 * 7/2002 Ravkin ..... 15/77
6,428,394 B1 * 8/2002 Mooring et al. ..... 451/41
6,558,239 B1 * 5/2003 Kunisawa et al. ..... 451/307
6,604,988 B1 * 8/2003 Talieh et al. ..... 451/59
6,685,541 B1 * 2/2004 Brown et al. ..... 451/41
6,729,944 B1 * 5/2004 Birang et al. ..... 451/296
6,746,320 B1 * 6/2004 Krusell et al. ..... 451/302
6,837,777 B1 * 1/2005 Ziemins et al. ..... 451/44
2001/0052159 A1 * 12/2001 Moinpour et al. ..... 15/102
2003/0203710 A1 * 10/2003 Balakumar et al. ..... 451/59
2004/0087259 A1 * 5/2004 Talieh et al. ..... 451/173

* cited by examiner

*Primary Examiner*—David B. Thomas
*Assistant Examiner*—Robert Scruggs
(74) *Attorney, Agent, or Firm*—Martine Penilla & Gencarella, LLP

(57) ABSTRACT

A wafer bevel processing apparatus comprises a plurality of rollers for rotatably supporting a wafer, first process roller, a second process roller, and a process tape extending between the first process roller and the second process roller. The first and second process rollers are positioned to cause the process tape to contact an edge of the wafer when the wafer is loaded into the processing apparatus. The process tape is configured to frictionally prepare the edge where contact occurs with the process tape.

19 Claims, 7 Drawing Sheets

PROCESS TAPE FOR CLEANING OR PROCESSING THE EDGE OF A SEMICONDUCTOR WAFER

BACKGROUND OF THE INVENTION

1. Field of the Invention

The present invention relates generally to semiconductor wafer cleaning and preparation, and more particularly, to a method and apparatus for cleaning or preparing wafer edges after various fabrication operations.

2. Description of the Related Art

In the field of semiconductor chip fabrication processing, it is well known that there is a need to clean a semiconductor substrate wafer where a fabrication operation has been performed that leaves unwanted residuals on the surface of the wafer. Examples of such fabrication operations include plasma etching, material depositions and chemical mechanical planarization (CMP). CMP is commonly performed on both dielectric materials and conductive materials such as oxide and copper. If particles or films are left on the surface of the wafer without removing them, the unwanted residual particles or material may cause defects on the wafer surface and inappropriate interactions between metallization features or with subsequent lithography operations. Such defects may cause devices on the wafer to become inoperable. It is therefore necessary to clean the wafer after fabrication operations that leave unwanted residuals on the surface of the wafer.

A common fabrication operation includes the deposition of metals over previously formed dielectric features, which is commonly done in damascene and dual-damascene processes. As is generally defined, damascene and dual-damascene processes include the formation of features, such as interconnect lines and vias into dielectric materials, filling the dielectric features with conductive material, e.g., such as copper, and then performing CMP operations to remove the excess metallization material. The metal material can be formed over the wafer using various techniques, such as, for example, deposition, electroplating, sputtering, and the like. In either case, the formation of metal material may generate excess beading around the periphery of the wafer. It is also a common operation to perform standard cleaning operations after such metal deposition operations, to ensure that the excess material, debris, and contaminants are removed from the wafer before engaging in further processing.

Standard brush scrubbing techniques often fail to clean and remove the metal edge beading and loose particles from wafer edge surfaces including the bevel edge and exclusion zone which extends from about 1 to 3 millimeters from the bevel. Although sufficient center cleaning is performed using roller brushes, not enough mechanical scrubbing is performed at the edge. Consequently, unwanted material may remain even after repeated conventional brush cleaning.

FIG. 1 shows an exemplary prior art wafer brush-box 50. The brush-box 50 includes a drive roller 61 that rotates in a direction 62 that drives the wafer 12 in a direction 63, and a stator roller 68 that forces the wafer into engagement with the circumferential groove 70 of drive roller 61. Edge cleaner 65 cleans the bevel 74 of the wafer 12. Edge cleaner 65 may rotate in the direction 67 at a different speed than the drive roller 61 to provide some scrubbing action between edge cleaner 65 and wafer bevel 74. Edge cleaner 65 comprises a grooved roller having a soft compliant material lining the groove for conforming to the edge profile and removing debris. An exemplary edge cleaner of this type is shown in U.S. Pat. No. 6,334,229, which issued to Moinpour et al. on Jan. 1, 2002. Stationary, U-shaped scrub brush edge cleaners are also known.

Unfortunately, prior art wafer edge cleaners must be replaced periodically, increasing operating costs. Furthermore, the prior art devices have a small area of contact between the cleaning implement and the wafer. The small area of contact results in reduced efficiency in cleaning, requiring longer cleaning times.

In view of the foregoing, there exists an unmet need for a substrate edge cleaning system and method that provides a less costly, more effective and efficient alternative to current technologies.

SUMMARY OF THE INVENTION

Broadly speaking, the present invention fills these needs by providing an improved substrate bevel and exclusion zone cleaning mechanism. It should be appreciated that the present invention can be implemented in numerous ways, including as a process, an apparatus, a system, computer readable media, or a device. Several inventive embodiments of the present invention are described below.

One embodiment includes a wafer bevel processing apparatus comprises a first process roller, a second process roller, and a process tape extending between the first process roller and the second process roller. The first and second process rollers are positioned so as to engage a wafer edge. The process tape comprises a material suitable for one of cleaning, scrubbing, or abrading at and around the wafer edge.

In another embodiment, a method for processing a bevel of a semiconductor wafer is provided. In the method, a process tape is extended between a first process roller and a second process roller so that the bevel of the wafer contacts the process tape. The wafer is rotated on its axis so that the entire circumference of the wafer is processed.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

DETAILED DESCRIPTION

Several exemplary embodiments for wafer bevel and exclusion zone cleaning system are described below. It will be apparent to those skilled in the art that the present invention may be practiced without some or all of the specific details set forth herein.

Figure 1:
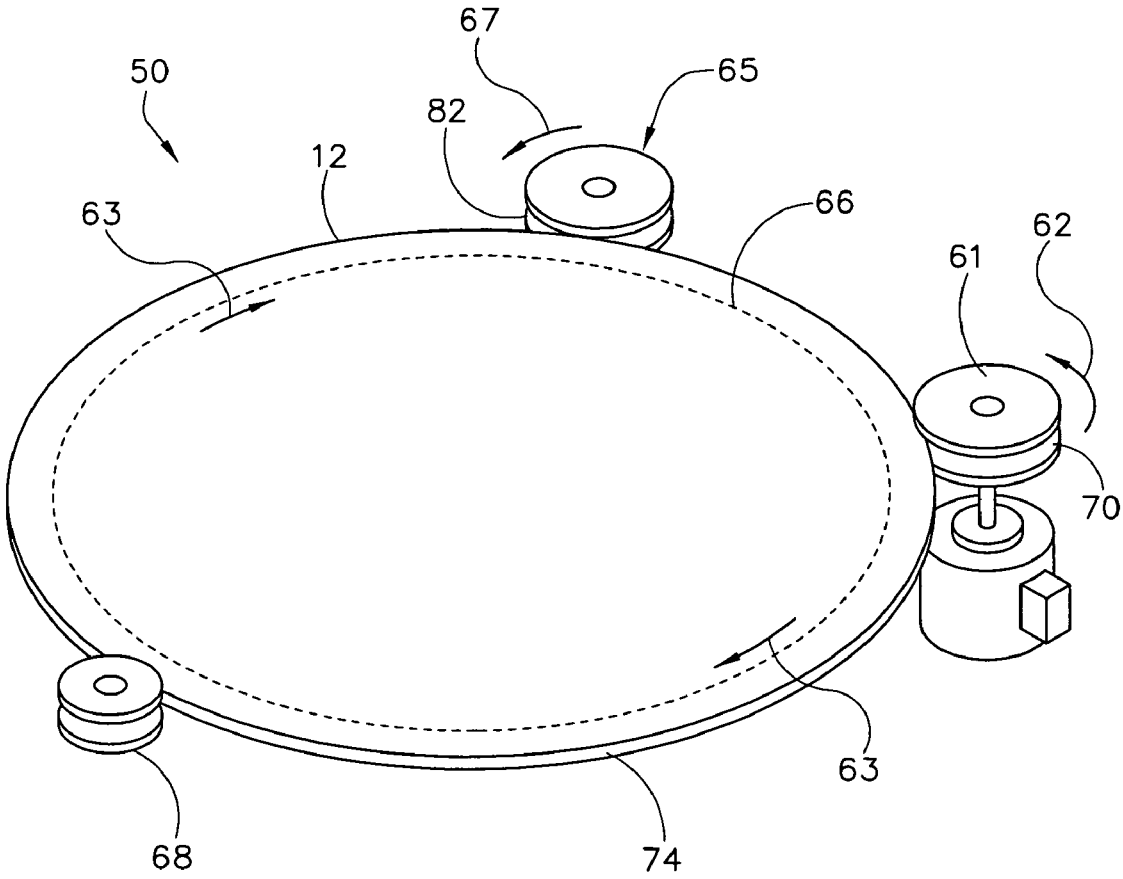
FIG. 1 PRIOR ART
FIG. 1 shows a prior art wafer bevel and exclusion zone cleaning apparatus.
Figure 2A:
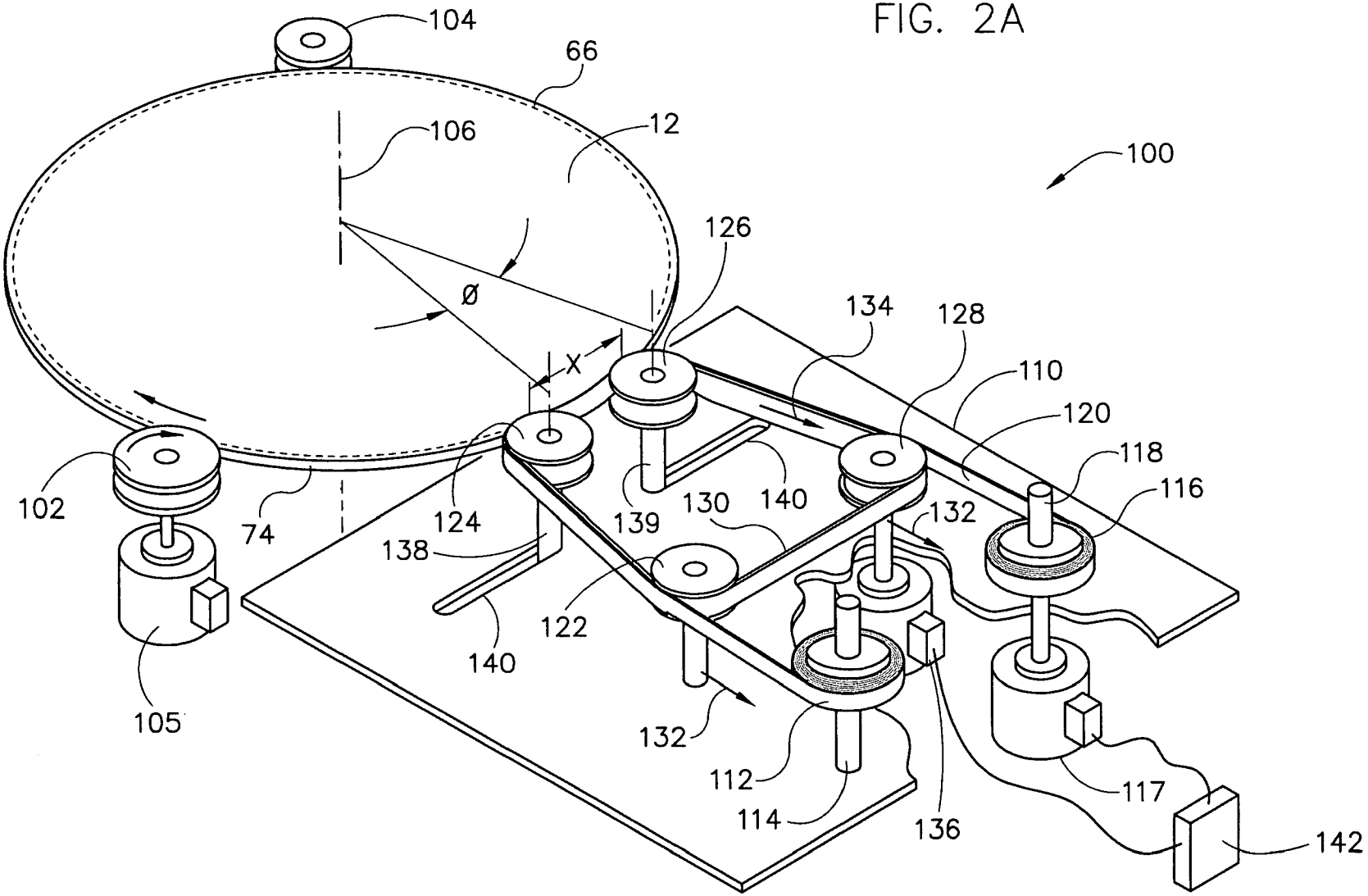
FIG. 2A shows one embodiment of a wafer bevel and exclusion zone cleaning apparatus.

FIG. 2A shows one embodiment of an edge cleaning apparatus 100. Cleaning apparatus 100 comprises a plurality of rollers to support and rotate wafer 12. Any number of rollers may be used. In one embodiment, driver roller 102 and stator roller 104 engages wafer bevel 74 to support wafer 12. As used herein, the wafer bevel 74 is defined to include the wafer edge surface. As the edge of the wafer has a surface that is sometimes somewhat rounded or curved, the edge can extend up to or past the curved portions and onto the flat surface of either or both of the top and bottom of the wafer. The flatter surfaces near the edge are referred to as the edge region 66 and include what is commonly referred to as the exclusion zone. The term "wafer" should also be interpreted broadly, as other substrates such as magnetic media for hard drives can be similarly processed.

As shown, a cleaning mechanism 110 engages wafer bevel 74. In one embodiment, cleaning mechanism 110 comprises a process tape supply reel 112 on a first spindle 114 and a process tape take-up reel 116 on a second spindle 118. Process tape 120 passes from tape supply reel 112, around first drive loop roller 122, first process roller 124, second process roller 126 and second drive loop roller 128, and returns to process tape take-up reel 116.

A drive belt 130 is a continuous belt that extends around first and second drive loop rollers 122, 128 and first and second process rollers 124, 126. Drive belt 130 is formed from a strong flexible material that frictionally engages process tape 120. Drive belt 130 may include friction enhancing features (not shown) such as protruding spikes, nubs, ridges, etc, to increase friction between belt drive 130 and process tape 120. One or both drive loop rollers 122, 128 may be spring biased in direction 132 away from wafer 12 to place drive belt 130 in tension. The tension of drive belt 130 will cause it to exert pressure on process tape 120 which in turn increases the pressure against wafer bevel 74, which improves the performance of cleaning mechanism 110.

Drive belt 130 is driven in direction 134 by belt drive motor 136, which, for example, may be a stepping motor. In other embodiments, it is contemplated that only one drive loop roller is required, the single drive loop roller being connected to the belt drive motor. It is also contemplated that belt drive motor may be connected to one of the first and second process rollers, and therefore no drive loop rollers would be required. In this case, drive belt 130 would extend only around the two process rollers.

A take-up drive mechanism 117 drives process tape take-up reel 116. In one embodiment, take-up drive mechanism 117 comprises an electric motor. If take-up drive mechanism 117 is an electric motor, it can be operated using a tensioning pulley (not shown) or rod, connected to a microswitch to advance take up reel 116 when too much slack is present as detected by the tensioning pulley. Alternatively, it can be controlled by control unit 142 to be activated along with belt drive motor 136. In an alternate embodiment, take-up drive mechanism 117 may comprise some mechanical linkage (not shown) to belt drive motor 136. Note that there may be some friction device allowing take up wheel 116 to slip with respect to spindle 118 to maintain appropriate tension of process tape 120.

Process tape 120 may comprise different materials depending upon the application. For example, when used for removing particulates, process tape 120 may comprise a soft compliant polyurethane pad material as known in the art for cleaning, polishing, and abrading (when used with an abrasive slurry) semiconductor wafers. Typical polyurethane pads, such as the either perforated or grooved IC 1000/SubaIV, include of pores or voids having an average diameter of about 30 μm, the voids accounting for approximately 30% of the volume of the pad. It is also known to use other materials for cleaning, polishing and abrading, including felt and mohair. When removing polymer buildup or metallization, a harder material may be used. A fluid or slurry dispenser or applicator (not shown) may be provided to wet process tape 120 to improve its cleaning or abrasive qualities. Drive belt 130 frictionally engages, backs, and supports process tape 120 thereby protecting process tape 120 from shearing and other stresses caused by the scrubbing action.

Process rollers 124, 126 are mounted to spindles 138, 139, respectively, which can be moved closer together or farther apart using an actuating mechanism (represented by slots 140). The distance between process rollers 124, 126 causes a contact distance x to vary. Depending on the application of the device and other considerations, the distance can be varied to accommodate various goals. For example, a larger contact area may be required for abrading or scrubbing, while a smaller contact area may be necessary when simply brushing away particulates.

Figure 2B:
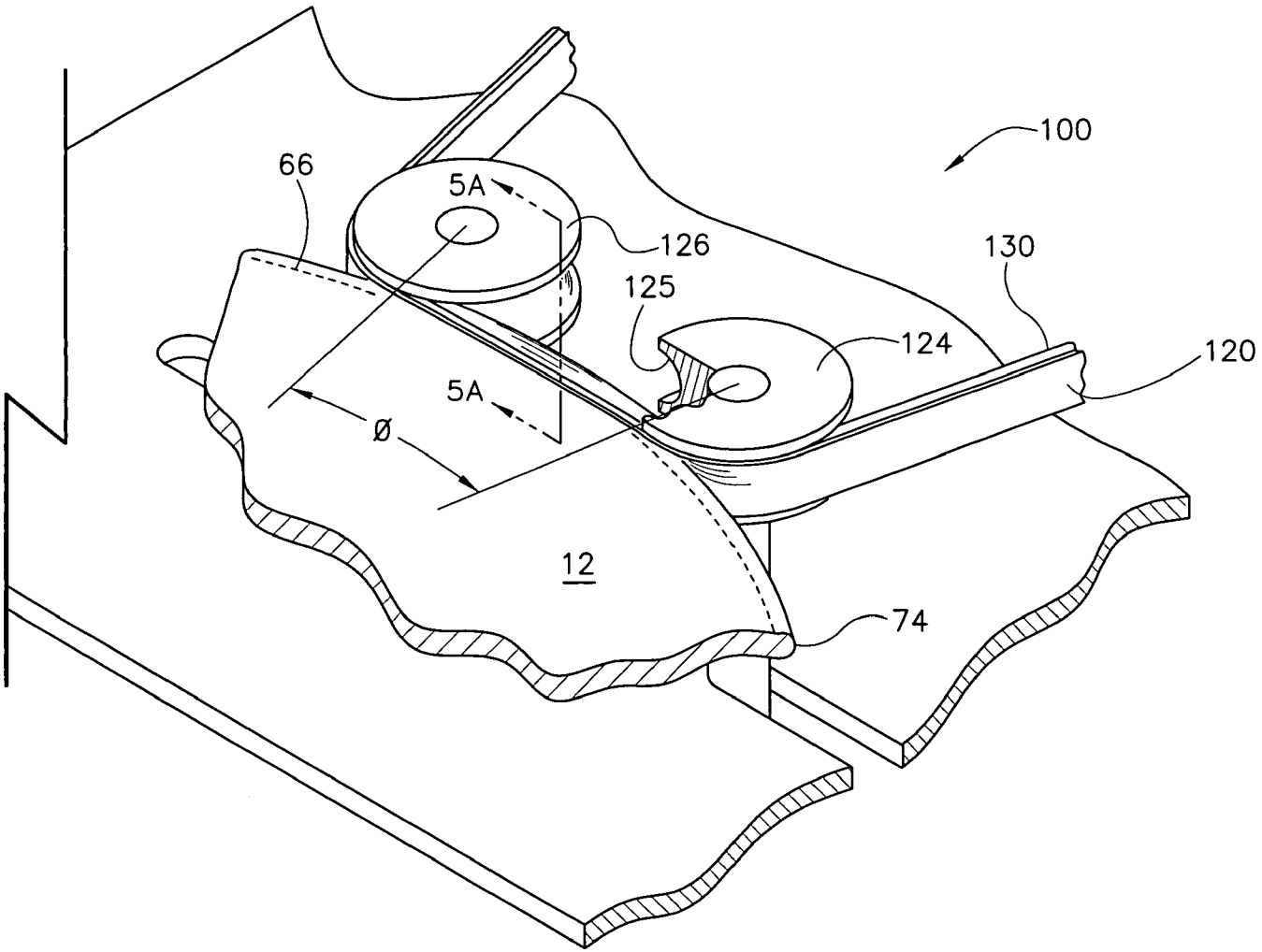
FIG. 2B shows a detail view of process rollers and process tape of the embodiment shown in FIG. 2A.
Figure 5A:
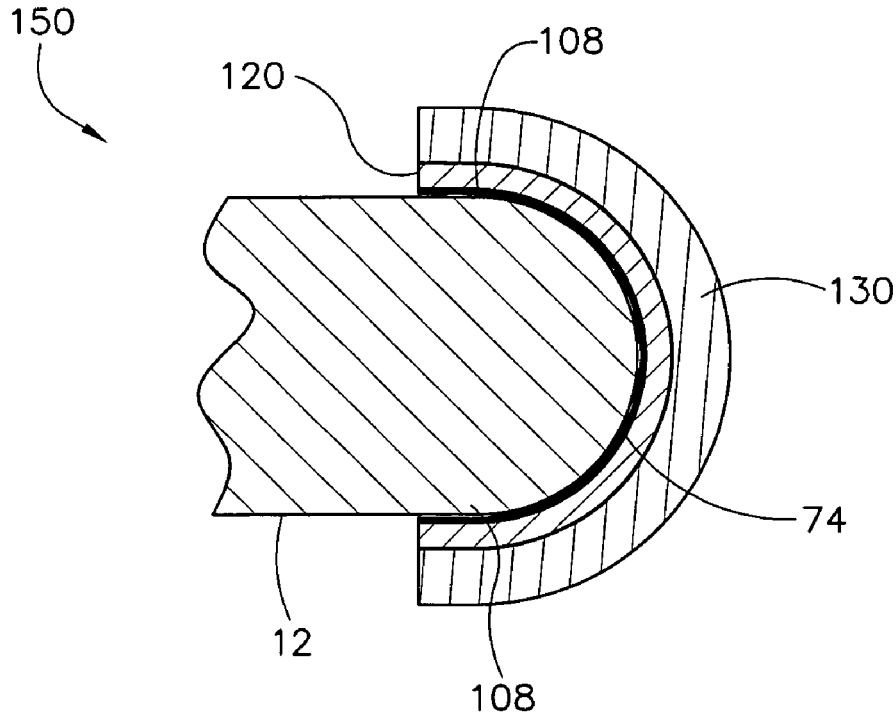
FIGS. 5A and 5B show detail views of process tape wrapping around a wafer bevel.

The axes of process rollers 124, 126 form an angle $\phi$ with the wafer axis 106. The curvature of bevel 74 and tension of process tape 120 around angle $\phi$ causes process tape 120 and drive belt 130 to curl or form around bevel 74 and contact edge region 66, which includes the exclusion zone. FIG. 2B shows a detail view of process rollers 124, 126 with process tape 120 and drive belt 130 engaging a wafer 12. In one embodiment, each process roller 124, 126 has a circumferential groove 125 in the outer perimeter that can engage wafer bevel 74. However, circumferential groove 25 is not necessarily required as the process tape 120 will curl or form around bevel 74 in response to edge perimeter curvature even in the absence of circumferential groove 125. Process tape 120 and drive belt 130 pass between process rollers 124, 126 and wafer bevel 74. As process tape 120 and drive belt 130 traverses the angle $\phi$ around wafer bevel 74, the upper and lower edges wrap around bevel 74 and contact edge region 66 of wafer 12, as shown by cross-section view 150 in FIG. 5A. Because process tape 120 is flexible, it wraps around bevel 74 and easily conforms to any geometry of the bevel.

Referring to FIG. 2A, cleaning mechanism 110 includes a controller 142 which may be located locally or remotely from cleaning mechanism 110. Controller 142 operates belt drive motor 136 to advance process tape 120 by advancing drive belt 130. The operation of cleaning system 100 may vary depending on the application. In one exemplary application, in what may be referred to as an indexing operation, belt drive motor 136 and drive belt 130 advances process tape 120 until a clean unused portion thereof is extending between process rollers 124, 126. A wafer is then positioned between stator roller 104, drive roller 102, and process rollers 124, 126, and the wafer is rotated against the stationary process tape 120 causing a scrubbing action between contact area of process tape 120 and wafer bevel 74 and edge regions 66 of wafer 12. In another exemplary operation, process tape 120 is slowly advanced during the cleaning process. In this case, a mechanical linkage such as a belt, gear or other device (not shown) may be provided between drive motor 105 and one of drive loop rollers 122, 128 and/or process rollers 124, 126. In yet another exemplary operation, process tape 120 may be reciprocated using belt drive motor 136 to provide enhanced scrubbing action. When reciprocating, supply reel 112 can take up slack using a friction-slip spring return (not shown) which may comprise a coiled spring connected to supply reel 112 at one end and frictionally engaging a spindle 114, which may be fixed, at the other end.

Note that other cleaning processes may take place simultaneously with the bevel and exclusion zone cleaning process. For example, top and bottom brush rollers (not shown) may engage and scrub the top and bottom surfaces of wafer 12 while bevel and exclusion zone cleaning is taking place. During the cleaning process, cleaning and/or rinsing chemicals as known to those skilled in the art such as deionized water may be sprayed on wafer 12 to aid in carrying away debris loosened by brush rollers (not shown) and process tape 120.

Figure 3:
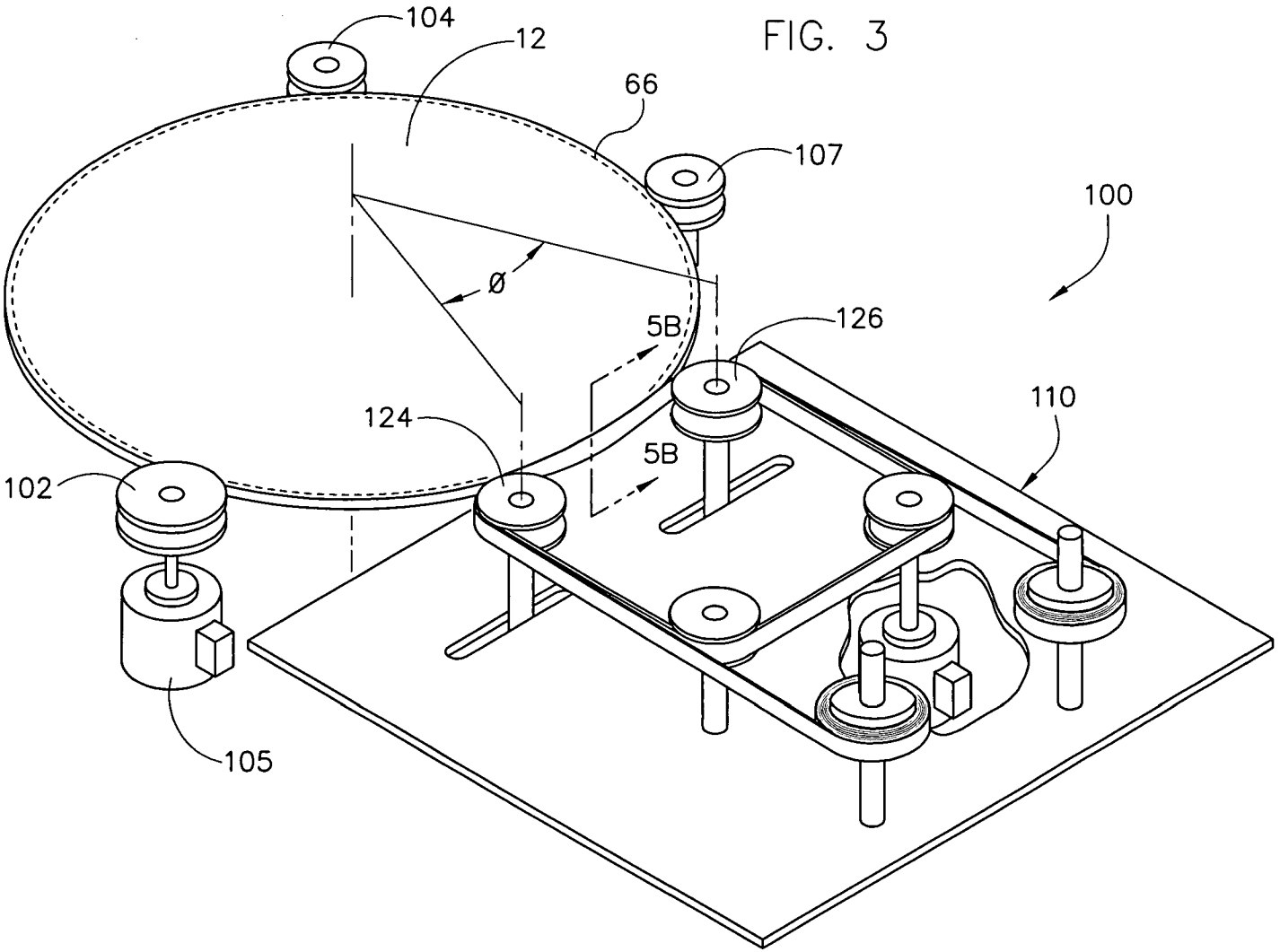
FIG. 3 shows an embodiment with the circumferential grooves of the process rollers moved out of engagement with the wafer edge.
Figure 5B:
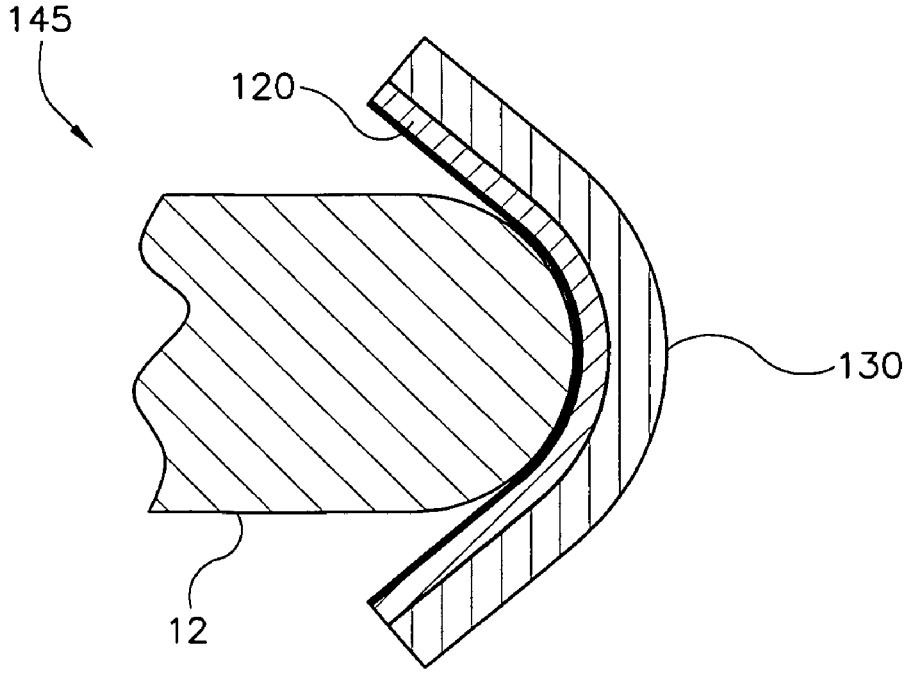

FIG. 3 shows an operational variation wherein process rollers 124, 126 are moved far apart and are not in engagement with wafer 12. To support wafer 12, a second stator roller 107 cooperates with stator roller 104 and drive roller 102. In this case, process tape is permitted to uncurl slightly so that it does not contact the edge region 66 of wafer 12, as shown in cross-section view of FIG. 5B.

Figure 4:
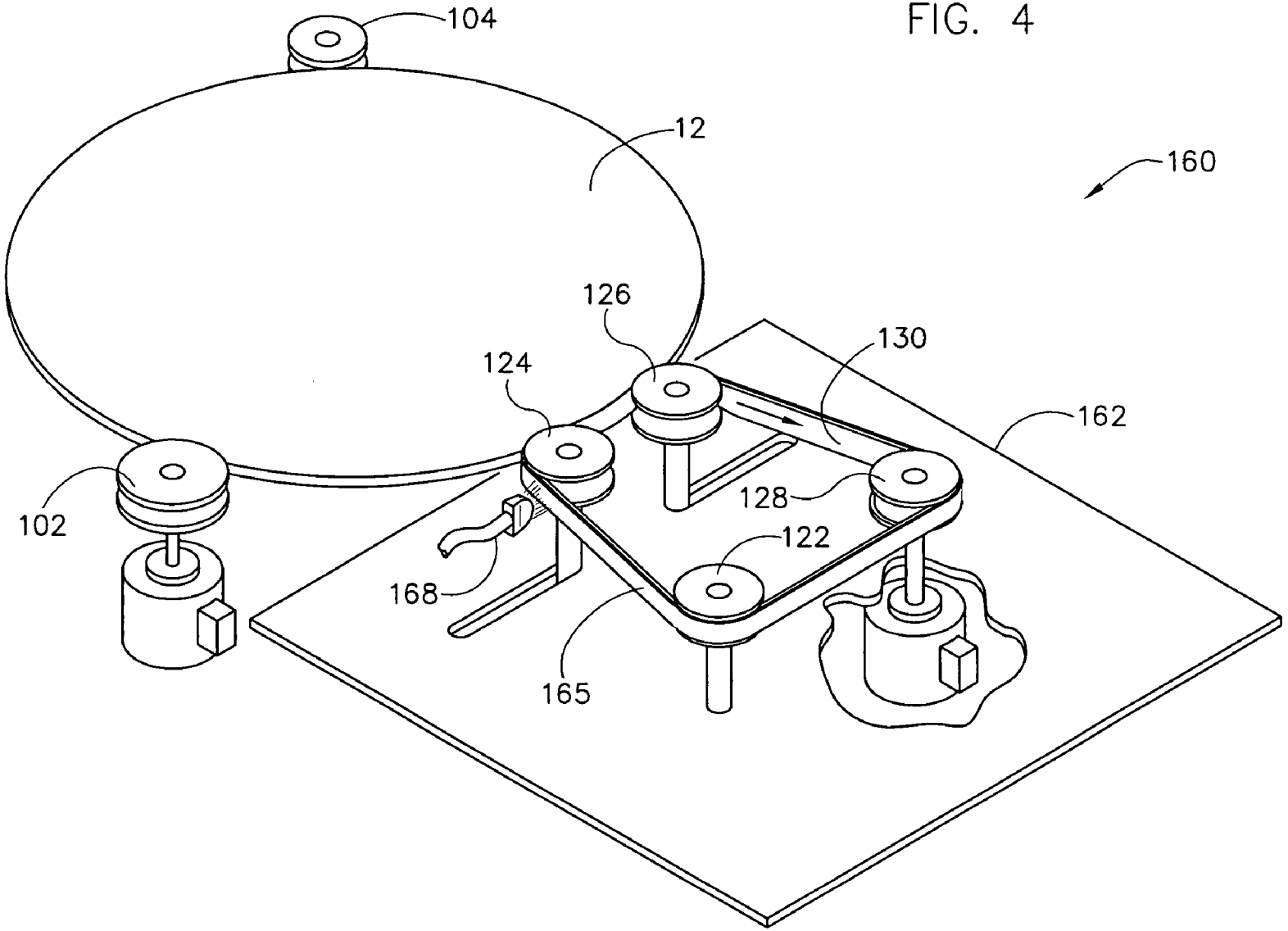
FIG. 4 shows an embodiment having a cleaning apparatus that uses a continuous process tape.

FIG. 4 shows another embodiment comprising a cleaning apparatus 160 using a continuous process tape 165. Process tape 165 may comprise a soft flexible material requiring a stronger backing belt to stabilize it, or it may comprise a stronger material or multi-layer material as described below with reference to FIG. 6. Continuous process tape 165 is positioned around process rollers 124, 126 and drive loop rollers 122, 128. Process tape 165 may be reusable and, in one embodiment, is rinsed by spray nozzle 168 to remove debris from previous cleaning operations. Note that a continuous process tape 165 can be used without changing the configuration of cleaning apparatus 100 shown in FIG. 2A thereby providing multiple modes of operation of the cleaning apparatus 100. It is anticipated that continuous process tape 165 would cost less and last longer than prior art cleaning rollers or stationary brushes.

Figure 6:
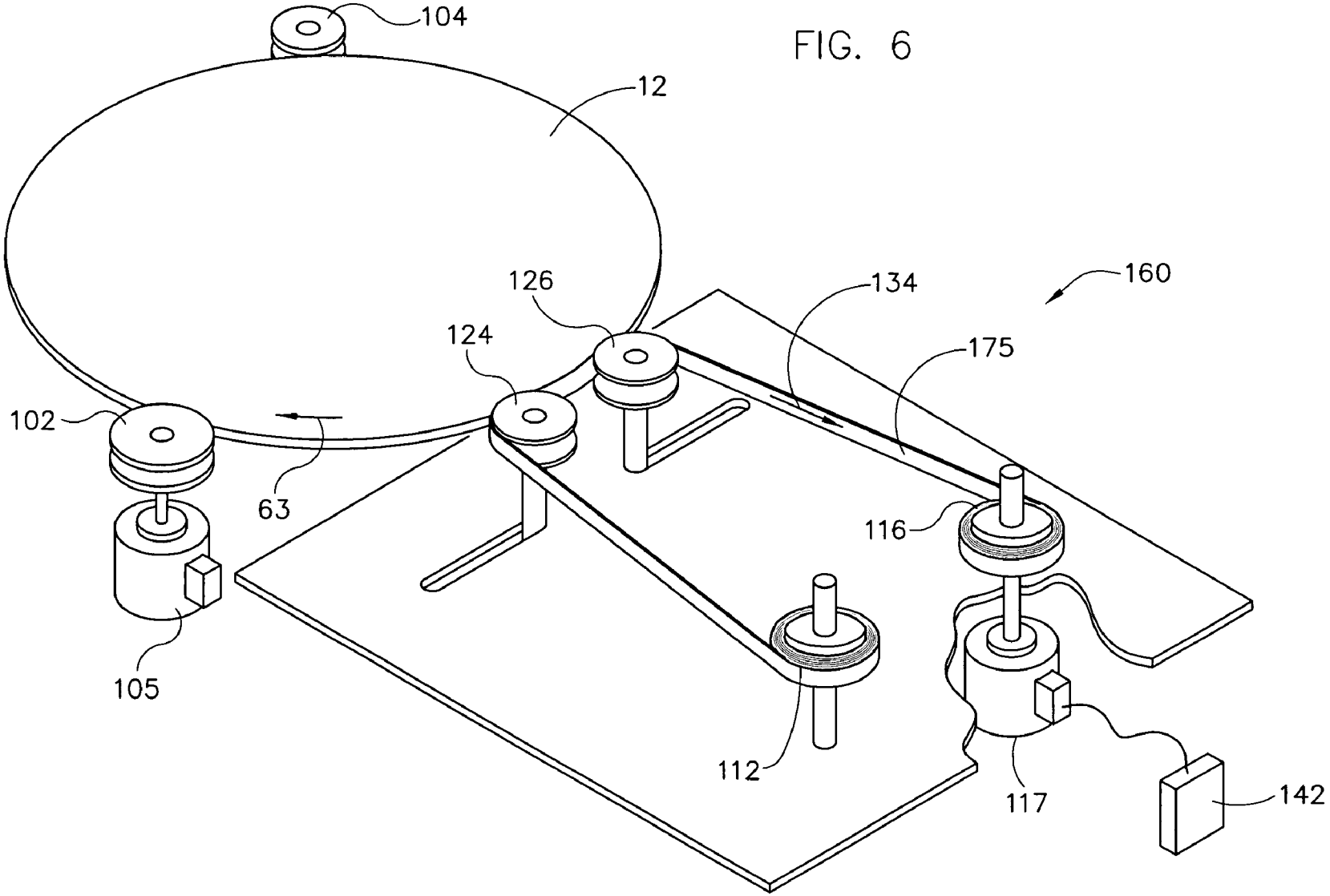
FIG. 6 shows an alternate embodiment of a bevel and exclusion zone cleaning system using a strong process tape.

FIG. 6 shows an alternate embodiment of a bevel and exclusion zone cleaning system 170 using a process tape 175 that is strong enough to withstand the tension of take-up drive mechanism 117 and sheer stresses resulting from the scrubbing action with wafer 12. Process tape 175 may comprise a layered structure comprising a layer of process material such as a scrubbing pad bonded to a backing material such as a fabric formed from a polyamide or like material, vinyl, polyester, or other strong, flexible material. The scrubbing pad layer may be bonded to the backing material by use of an adhesive, by welding, e.g., using ultrasonic welding, or by mechanically engaging the scrubbing pad to the backing layer, or by other known means. In another embodiment, process tape 175 comprises a scrubbing pad material that is sufficiently strong so as not to need a backing material to support and stabilize it. In other aspects, cleaning apparatus 160 operates similarly to the embodiment shown in FIG. 2A.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. An edge processing apparatus comprising:

a plurality of support rollers positioned for rotatably supporting a substrate such that the substrate is rotatable on an axis perpendicular to a flat surface of the substrate;

a first process roller and a second process roller, the first process roller and second process roller each having an axis of rotation, the axis of rotation being substantially parallel with the axis of the substrate;

a process tape extending between the first process roller and the second process roller, the first and second rollers being positioned to cause the process tape to contact an edge of the substrate when the substrate is loaded into the processing apparatus, the process tape being configured to frictionally prepare the edge where contact occurs with the process tape; and wherein the first process roller and second process roller each have a circumferential groove formed in an outer circumference, the circumferential groove causing the process tape to substantially form around the edge and at least partially contact an edge region of the substrate when processing a substrate, the edge region comprising peripheral areas of front and back surfaces of the substrate.

2. An edge processing apparatus comprising:

a plurality of support rollers positioned for rotatably supporting a substrate such that the substrate is rotatable on an axis perpendicular to a flat surface of the substrate;

a first process roller and a second process roller, the first process roller and second process roller each having an axis of rotation, the axis of rotation being substantially parallel with the axis of the substrate;

a process tape extending between the first process roller and the second process roller, the first and second rollers being positioned to cause the process tape to contact an edge of the substrate when the substrate is loaded into the processing apparatus, the process tape being configured to frictionally prepare the edge where contact occurs with the process tape; and wherein the first process roller and second process roller each have a circumferential groove formed in an outer circumference, the circumferential groove causing the process tape to substantially form around the edge and at least partially contact an edge region of the substrate when processing a substrate, the edge region comprising peripheral areas of front and back surfaces of the substrate.

3. The edge processing apparatus of claim 1, wherein the first process roller and the second process roller are mechanically coupled to an actuator that is configured change a separation distance between the first process roller and the second process roller, thereby changing a contact area, the contact area being an area of contact between the process tape and the substrate.

4. The edge processing apparatus of claim 1, wherein the process tape is continuous.

5. The edge processing apparatus of claim 4, wherein the process tape also extends around a drive roller, the drive roller being in mechanical communication with a drive mechanism to cause the drive roller to rotate thereby advancing the process tape.

6. The edge processing apparatus of claim 4, wherein the process tape includes an outer process layer for contacting the substrate, and an inner backing layer in contact with the first and second process rollers, the backing layer being placed in tension by the process rollers.

7. The edge processing apparatus of claim 6, wherein the process layer and backing layer are bonded to one another.

8. The edge processing apparatus of claim 1, further comprising an actuator in mechanical communication with the take-up reel and a controller causing the actuator to advance the process tape so that used process tape is wound on the take-up reel, wherein, when the process tape is advanced, it travels along the substrate in a direction counter to a direction of movement of the edge of the substrate.

9. An edge processing apparatus comprising:

a plurality of support rollers positioned for rotatably supporting a substrate;

a first process roller and a second process roller;

a process tape extending between the first process roller and the second process roller, the first and second rollers being positioned to cause the process tape to contact an edge of the substrate when the substrate is loaded into the processing apparatus, the process tape being configured to frictionally prepare the edge where contact occurs with the process tape;

a drive roller;

a belt drive mechanism in mechanical communication with the drive roller, the belt drive mechanism being configured to cause the drive roller to rotate;

a drive belt in tension and extending around at least the drive roller, the first process roller and the second process roller, the process tape contacting the drive belt where the drive belt wraps around the first and second process rollers, the drive belt supporting and stabilizing the process tape at a location of contact between the process tape and the substrate, the drive belt causing the process tape to advance when the drive belt is advanced using the belt drive mechanism.

10. The edge processing apparatus of claim 9, wherein the belt drive mechanism is an electric motor.

11. The edge processing apparatus of claim 9, further comprising a controller for operating the belt drive mechanism, wherein the controller advances the belt drive causing an unused segment of process tape to extent between the first and second process rollers prior to processing a substrate.

12. A method for processing an edge of a substrate, the method comprising:

rotating the substrate on an axis of the substrate;

extending a process tape between a first process roller and a second process roller the first process roller and the second process roller each having an axis of rotation, the axis of rotation being substantially parallel with the axis of the substrate, the first process roller and the second process roller each having a circumferential groove formed around their perimeter;

positioning a substrate such that the edge of the substrate contacts the process tape;

engaging the circumferential grooves with the edge of the substrate; and processing an edge region of the substrate by causing the process tape to substantially form around the edge at least in part using circumferential grooves formed into the first and second process rollers, the edge region comprising peripheral areas of front and back surfaces of the substrate.

13. The method of claim 12, wherein the extending further comprises extending the process tape from a supply reel, around the first process roller and the second process roller, to the take-up reel, the method further comprising rotating the take-up reel so that used process tape is wound on the take-up reel.

14. The method of claim 13, wherein the rotating the take-up wheel comprises advancing the process tape such that it travels along the substrate in a direction counter to a direction of movement of the edge of the substrate.

15. The method of claim 12, further comprising:

extending a drive belt in tension around at least a drive roller, the first process roller, and the second process roller such that the process tape contacts the drive belt where the drive belt wraps around the first and second process rollers, the drive belt supporting and stabilizing the process tape at a location of contact between the process tape and the substrate; and causing the process tape to advance by advancing the drive belt using a belt drive mechanism.

16. The method of claim 15 wherein the belt drive mechanism is an electric motor.

17. The method of claim 12, further comprising:

selecting a separation distance between the first process roller and the second process roller; and causing an actuator to modify the separation distance thereby changing a contact area, the contact area being an area of contact between the process tape and the substrate.

18. The method of claim 12, wherein the process tape is continuous.

19. The method of claim 18, wherein the process tape extends around a drive roller having a drive mechanism connected thereto to advance the process tape.

* * * * *